US008122574B2

(12) United States Patent
Dammermann

(10) Patent No.: US 8,122,574 B2
(45) Date of Patent: Feb. 28, 2012

(54) DEVICE AND METHOD FOR FASTENING

(76) Inventor: Kurt Philip Dammermann, San Francisco, CA (US)

( * ) Notice: Subject to any disclaimer, the term of this patent is extended or adjusted under 35 U.S.C. 154(b) by 456 days.

(21) Appl. No.: 12/421,226

(22) Filed: Apr. 9, 2009

(65) Prior Publication Data

US 2010/0257707 A1 Oct. 14, 2010

(51) Int. Cl.
*A44B 21/00* (2006.01)

(52) U.S. Cl. ..... 24/681; 24/594.11; 24/613

(58) Field of Classification Search ..... 24/591.1, 24/594.11, 607, 611, 613, 651, 681, 689, 24/DIG. 46
See application file for complete search history.

(56) References Cited

U.S. PATENT DOCUMENTS 624,746 A * 5/1899 Bottger ..... 24/601.7
890,608 A 6/1908 Cliff
1,118,022 A 11/1914 Klett
1,200,888 A * 10/1916 Schodsky ..... 24/669
1,325,577 A 12/1919 Pilkington
1,737,537 A 11/1929 Johnson
1,789,304 A 1/1931 Dyresen
1,805,356 A * 5/1931 Borresen ..... 24/613
2,898,656 A * 8/1959 Ashworth ..... 24/681
5,067,642 A * 11/1991 Fodge ..... 224/192
7,401,387 B2 * 7/2008 Rosemann ..... 24/289

* cited by examiner

*Primary Examiner* — Robert J Sandy
*Assistant Examiner* — Rowland D Do
(74) *Attorney, Agent, or Firm* — Jeffrey Schox

(57) ABSTRACT

A device for fastening includes a first component including an aperture, and a second component including a base with a perpendicular post to be inserted into the aperture to engage the fastener and of a diameter similar to the diameter of the aperture, a sprung latch with a flange to be inserted into the aperture along with the post that engages the surface of the first component underneath the aperture to fasten the second component to the first component, a rotating actuator that rotates on an axis on the base and actuates the flanges to allow clearance for insertion or extraction from the aperture, and a hinge to assemble the rotating actuator to the base.

24 Claims, 10 Drawing Sheets

FIGURE 3a
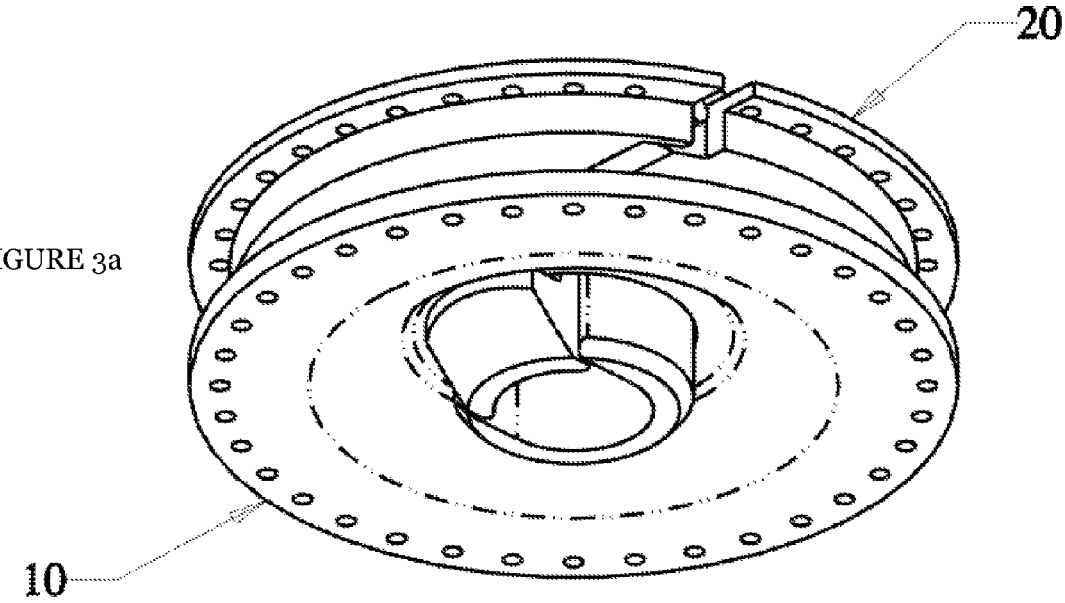
FIGURE 3b
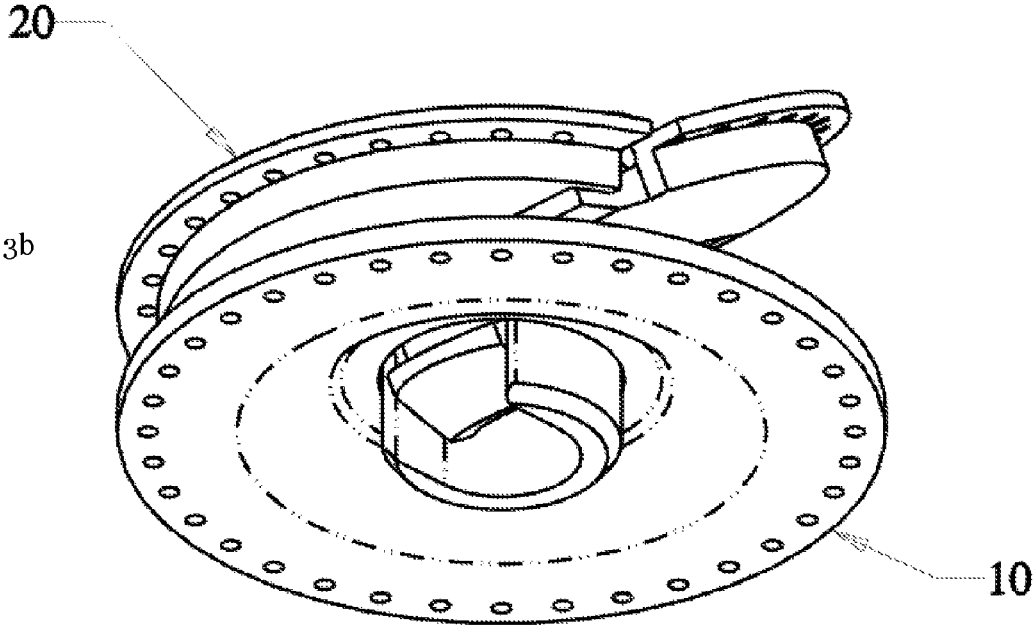
FIGURE 3

DEVICE AND METHOD FOR FASTENING

TECHNICAL FIELD

This invention relates generally to the mechanical field, and more specifically to a new and useful fastener in the field of mechanical fasteners.

BACKGROUND

Fasteners have applications in any scenario when two or more originally separate objects are to be joined, whether permanently or temporarily. Among temporary fasteners, there are one-time use fasteners and re-useable fasteners. Temporary fasteners typically have a method and mechanism to engage and disengage the fastener. These methods and mechanisms function for their purpose but typically have undesirable characteristics as well, for example, in hook and loop fasteners, the disengagement of the hooks from the loop creates a significantly loud sound (which is undesirable in certain locations, such as a library) and the hooks themselves may snag onto clothing, fabrics, or other materials. In another example, in click and latch type fasteners typically seen on lidded boxes, the engagement and disengagement mechanism defines a very rigid application geometry because the fastener requires the mating surfaces to come together at pre-defined angles with a degree of rigidity. In general, click and latch type fasteners include components that need to be accessed by the user to actuate the fastener, and thus must be mounted with at least a portion of the click and latch mechanism in plain view. In addition, such click and latch type fasteners may lose their fastening ability as the mating surfaces deform from age and use.

Thus, there is a need in the field of fasteners to create a new and useful fastener that overcomes at least some of these disadvantages of the hook and loop fasteners and click and latch fasteners. This invention provides such a new and useful fastener.

BRIEF DESCRIPTION OF THE FIGURES

FIGS. 3*a* and 3*b* are perspective views (from the top) of the first preferred embodiment in the fastened mode with the rotating actuator in a preferred first actuator position and with the rotating actuator in a preferred second actuator position, respectively.

DESCRIPTION OF THE PREFERRED EMBODIMENTS

Figure 1:
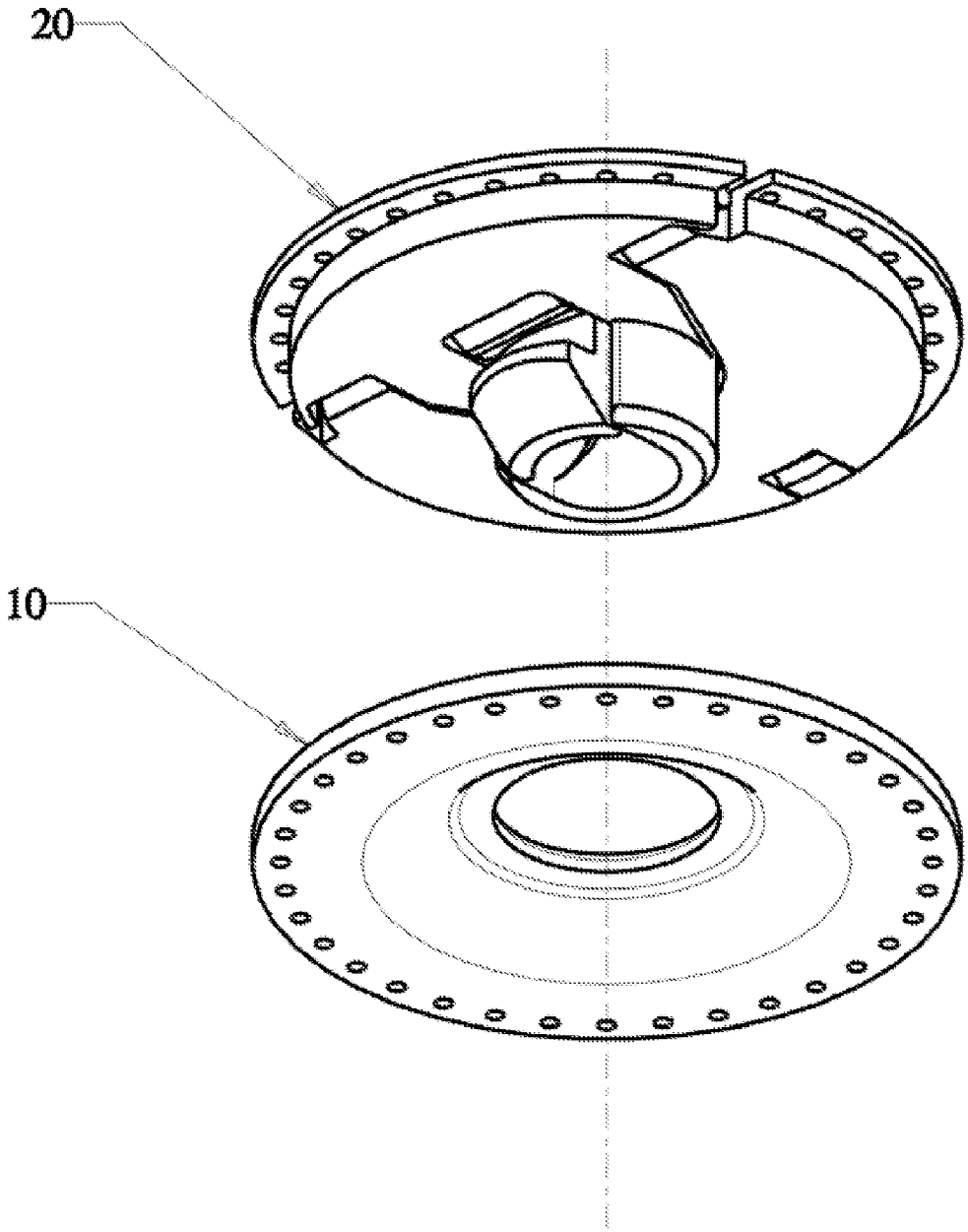
FIG. 1 is a perspective view (from the bottom) of a first preferred embodiment of the invention in the unfastened mode.

The following description of the preferred embodiments of the invention is not intended to limit the invention to these preferred embodiments, but rather to enable any person skilled in the art to make and use this invention.

As shown in FIGS. 1, 2, 5 and 6, the fastener of the preferred embodiments includes a first component 10 that includes an aperture 12 and a second component 20 that includes a base 22, a sprung latch 40, a rotating actuator 30, and a hinge 50 to couple the rotating actuator 30 with the base 22.

Figure 4A:
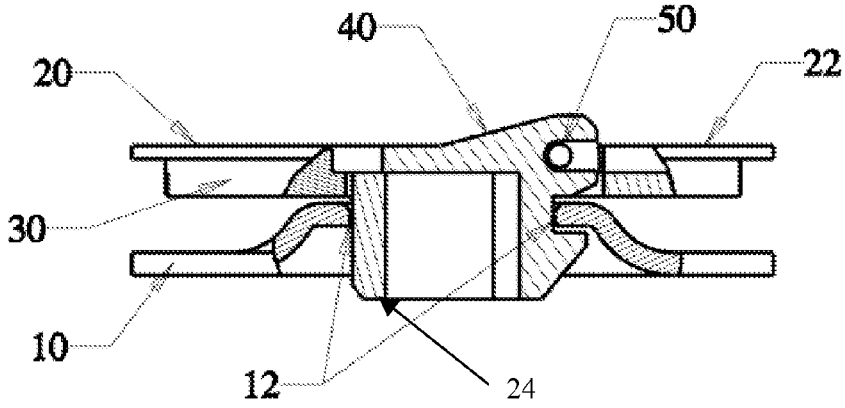
FIGS. 4*a*, 4*b*, and 4*c* are cross-sectional views of the first preferred embodiment of FIG. 3 in the fastened, insertion, and actuated states, respectively.
Figure 5:
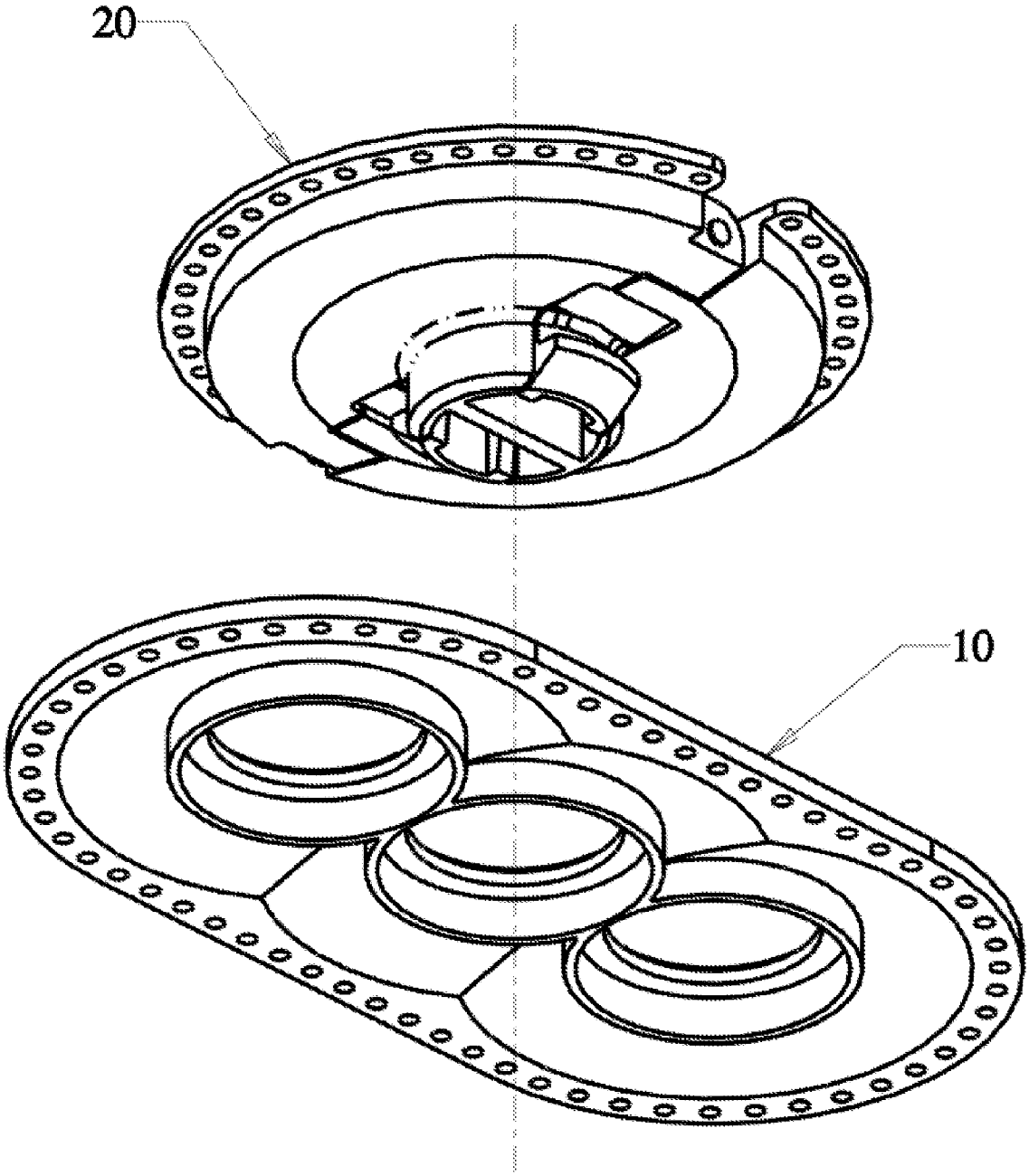
FIG. 5 is a perspective view (from the bottom) of a second preferred embodiment of the invention in the unfastened mode.
Figure 6:
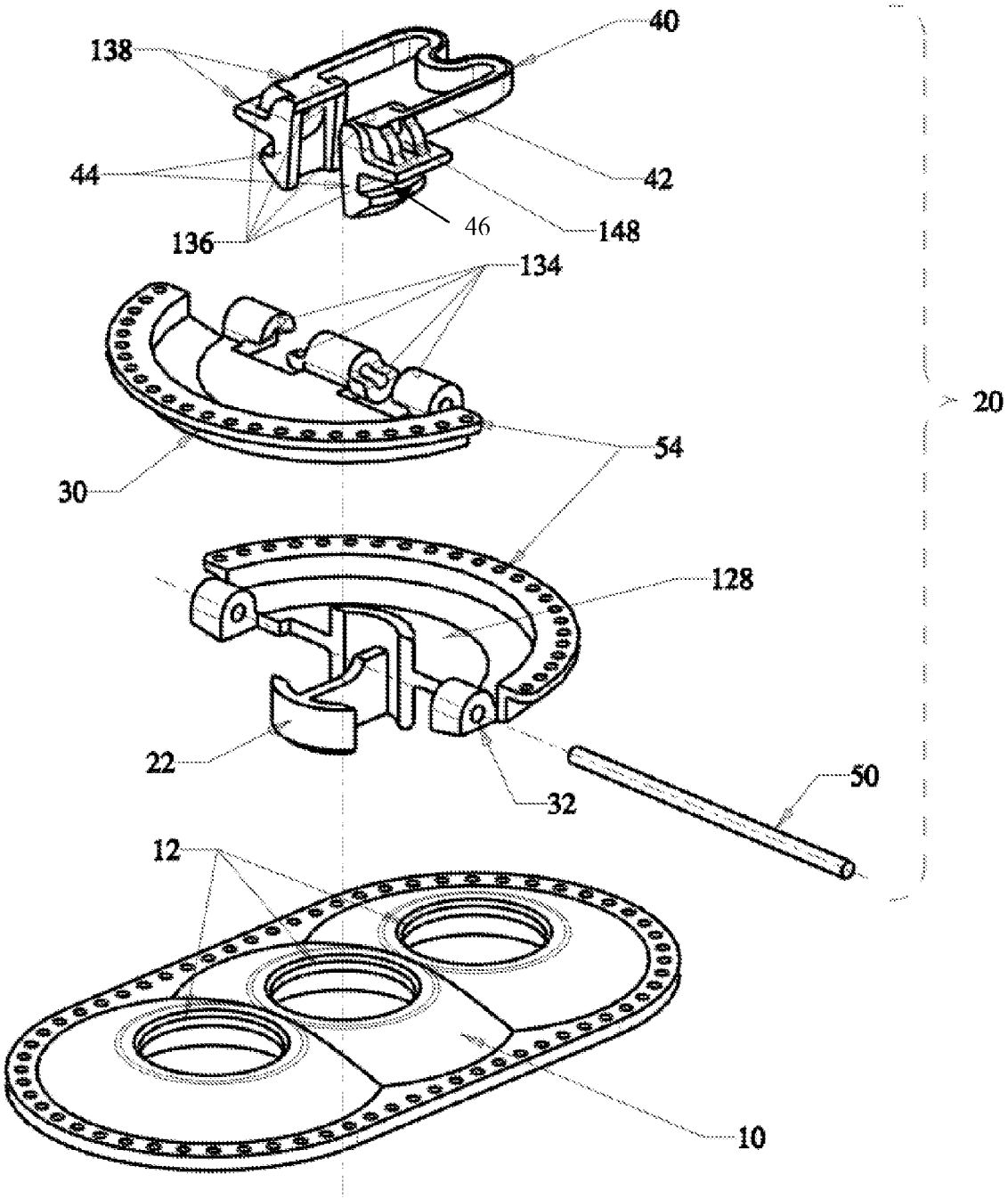
FIG. 6 is an exploded view of the second preferred embodiment.
Figure 7A:
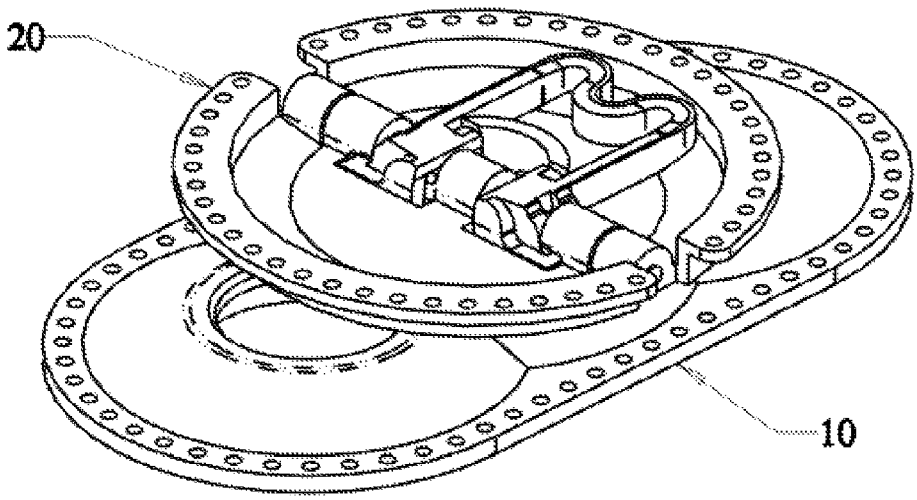
FIGS. 7*a* and 7*b* are perspective views (from the top) of the second preferred embodiment in the fastened mode with the rotating actuator in a preferred first actuator position and with the rotating actuator in a preferred second actuator position, respectively.
Figure 7B:
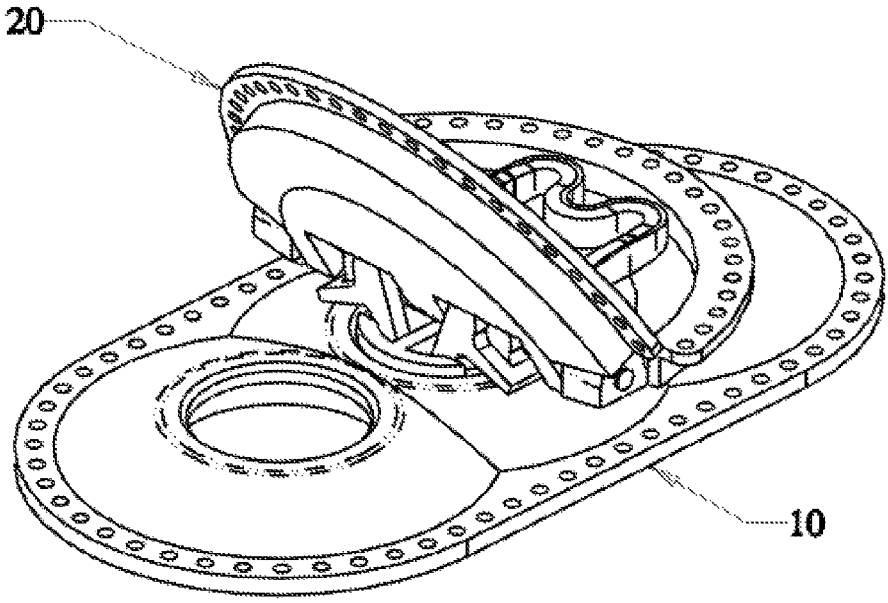

As shown in FIGS. 4 and 8, the first component 10 preferably contains a flat surface that is raised into a cone geometry in which the tip of the cone is removed, creating the aperture 12 and allowing an empty volume underneath the first component 10. The perimeter of the aperture 12 is preferably flattened and parallel to the flat surface to allow an interface location unto which the second component 20 fastens. However, any alternative geometry suitable to provide an interface location for the second component 20 to the first component 10 may be used. The first component 10 may alternatively include a plurality of apertures 12 to allow for a plurality of fastening locations (as shown in FIGS. 5 and 6). The plurality of apertures 12 may be of individual and separated apertures of the shape described above and as shown in FIGS. 5 and 6, but may alternatively be of overlapping apertures (for example, in the case of two overlapping apertures 12, the overlapping apertures 12 may create a shape similar to the outline of a "figure 8" geometry). Overlapping apertures may allow for a simpler manufacturing process. However, any other suitable arrangement of apertures 12 may be used.

Figure 2:
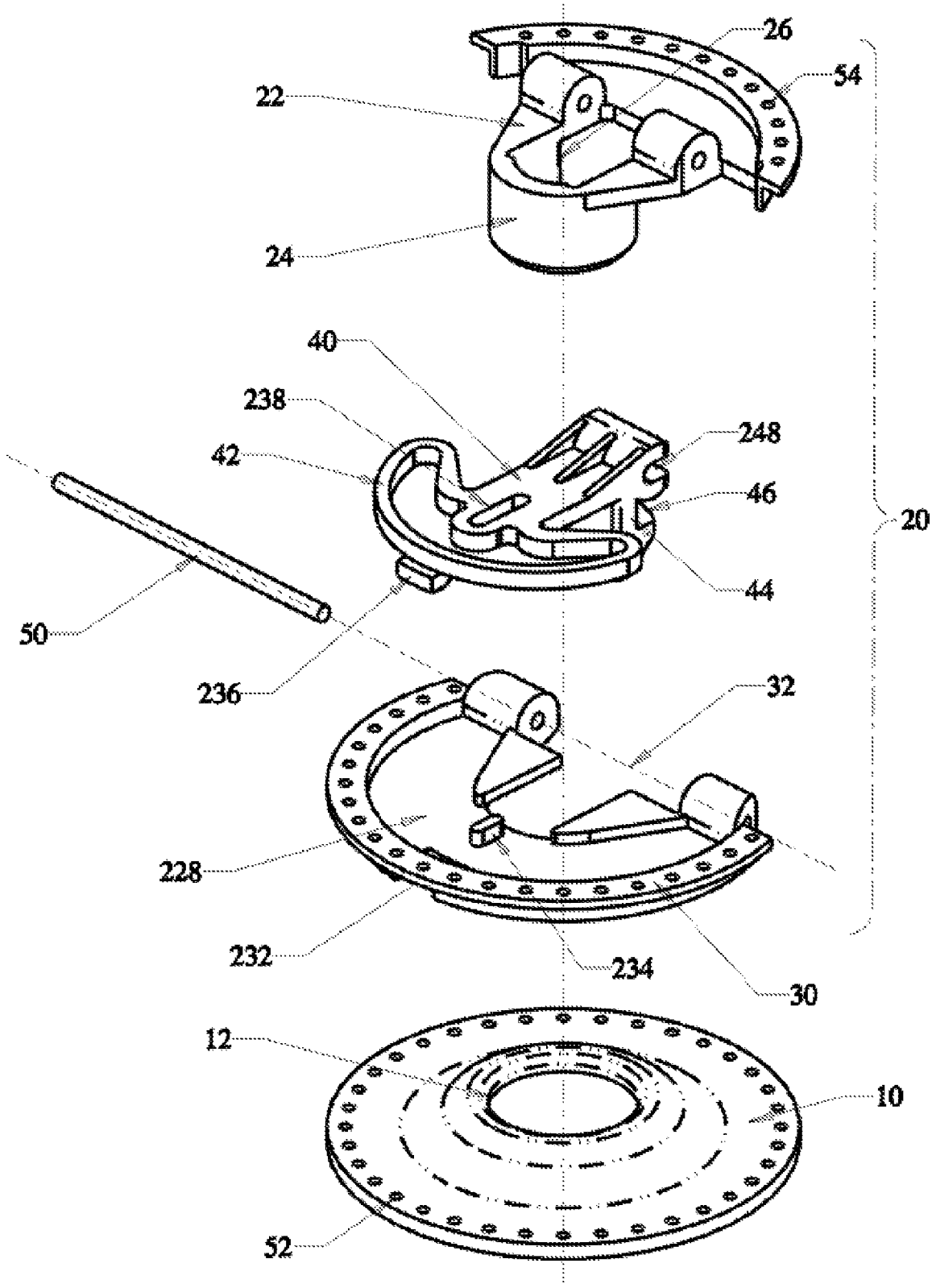
FIG. 2 is an exploded view of the first preferred embodiment.

As shown in FIGS. 2 and 6, the base 22 of the second component 20 includes a perpendicular post 24 with a diameter substantially similar to the diameter of the aperture 12 and a niche 26. The sprung latch 40 includes a spring 42 and a lever 44 with a flange 46. The rotating actuator 30 rotates about an axis 32. The post 24 of the base 22 is inserted into the aperture 12 to engage the fastener and is extracted from the aperture 12 to disengage the fastener. The lever 44 fits into the niche 26 of the post in a first lever 44 position to form a post 24 and lever 44 assembly such that the flange 46 extends beyond the perimeter of the post in a first flange 46 position. When inserting the post 24 into the aperture 12, the lever 44 is displaced from the first lever 44 position into a second lever 44 position such that the flange 46 is at a position interior of the first flange 46 position, providing clearance and allowing the post 24 and lever 44 assembly to be inserted into the aperture 12. The spring 42 of the sprung latch 40 then returns the lever 44 to the first lever 44 position, subsequently returning the flange 46 to the first flange 46 position, engaging the surface underneath the aperture 12, and locking the second component to the first component. The rotating actuator 30 rotates about an axis 32 located on the base 22 from a first actuator 30 position to a rotated actuator 30 position. The rotation causes the lever 22 to rotate from the first lever 22 position to a rotated lever 22 position such that the flange 26 is positioned interior to the first flange 26 position, providing clearance and allowing the post 24 and lever 44 assembly to be inserted or extracted from the aperture 12. The first actuator 30 position is preferably planar to the base 22, but may alternatively be perpendicular or any other angle relative to the base 22. For example, in a bag with a flap, the relative orientation of the bag and the flap may change as the bag becomes filled. A first actuator 30 position may be of an angle that allows the first and second components 10 and 20 to remain fastened when the bag is full. The angle of the first actuator 30 position may be adapted to the typical range of orientations between the bag and the flap to further increase the reliability of the fastener. However, any other suitable angle for the first actuator 30 position may be used.

In the preferred embodiments, the preferred method of engaging the fastener is by pushing the post 24 lever 44 assembly into the aperture, which displaces the lever 44 and gives clearance for insertion, or by rotating the rotating actuator 30 to rotate the lever 44 to give clearance for insertion. The method of disengaging the fastener is by rotating the actuator 30 to the rotated actuator 30 position to rotate the lever 44 to give clearance for extraction. The fastener preferably remains fastened until the actuator 30 is rotated, thus preventing separation of the second component 20 from the first component 10 when separation force is applied in any direction other than one in which the actuator 30 is rotated. Because the geometry of the post 24, the lever 44, and the aperture 12 preferably function to align the post 24 and the aperture 12 upon insertion, the methods for engagement allows for flexibility in application. The fastener may be used for two mating materials that come together from a variety of angles that, when fastened, become relatively parallel. The method of disengaging the fastener also allows for a large range of applications. The second component 20 may be mounted onto any surface that allows for the rotation of the rotating actuator 30 from the first actuator 30 position to the rotated actuator 30 position. This may include pliable cloth surfaces to be fastened to relatively stationary surfaces wherein the pliable cloth may be lifted from the stationary surface with a single peeling motion to disengage the fastener, non-pliable surfaces that give access to the rotating actuator 30 to allow the user to actuate the rotating actuator 30 directly, relatively non-pliable surfaces with a geometry that allows for creasing of the surface at a location relatively coaxial to the axis 32 wherein the user lifts the surface and subsequently creases the surface to rotate the rotating actuator 30, or any other surface suitable for actuation of the rotating actuator 30. Because neither the method of engaging nor the method of disengaging the fastener of the preferred embodiments requires the user to directly access any portion of the fastener, the fastener of the preferred embodiments may be hidden from view (for example, under the cover flap of a bag), allowing a substantial amount of flexibility in aesthetics, form, and geometry of the object to be fastened.

Figure 9A:
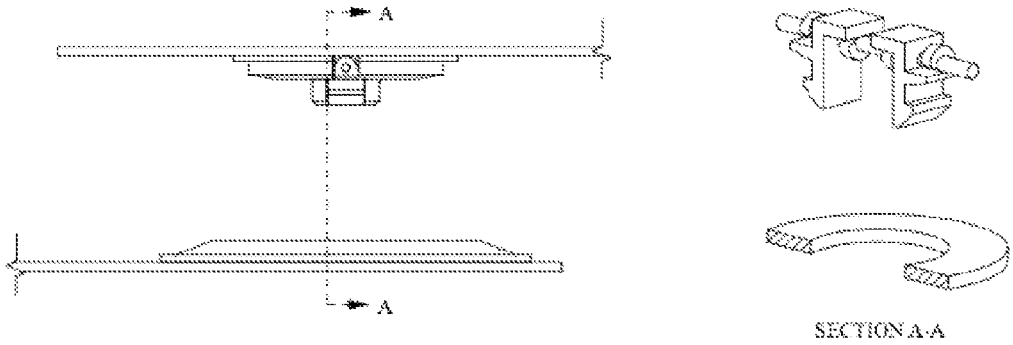
FIGS. 9*a*, 9*b*, and 9*c* are schematic representations of the three stages involved in the attachment process.
Figure 9B:
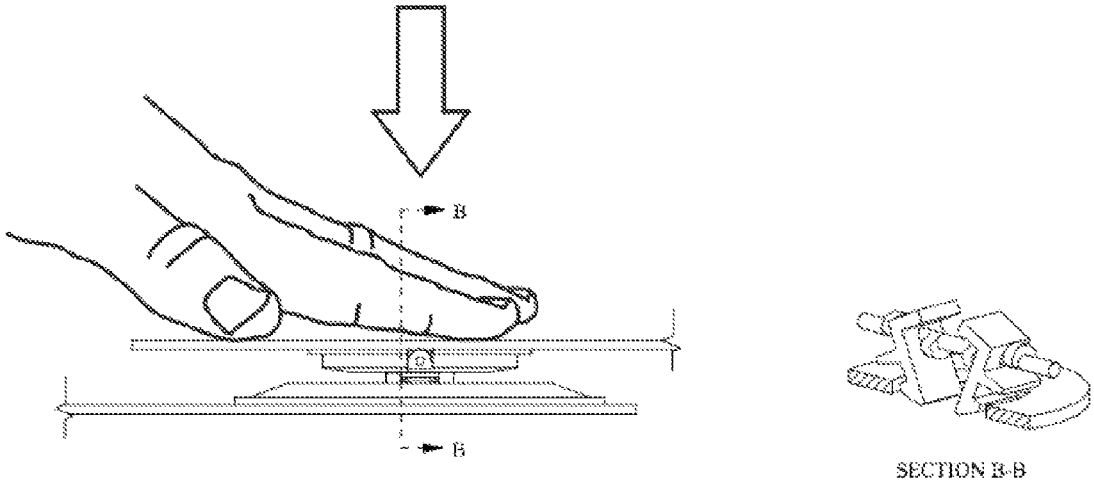
Figure 9C:
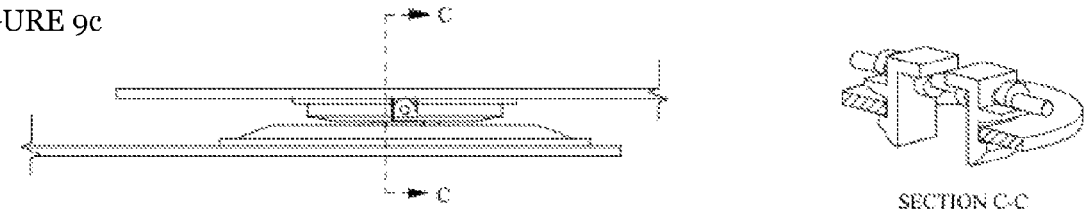
Figure 9D:
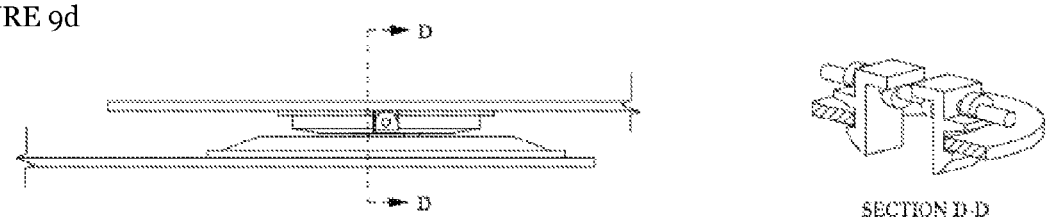
FIGS. 9*d*, 9*e*, and 9*f* are schematic representations of the three stages involved in the detachment process.
Figure 9E:
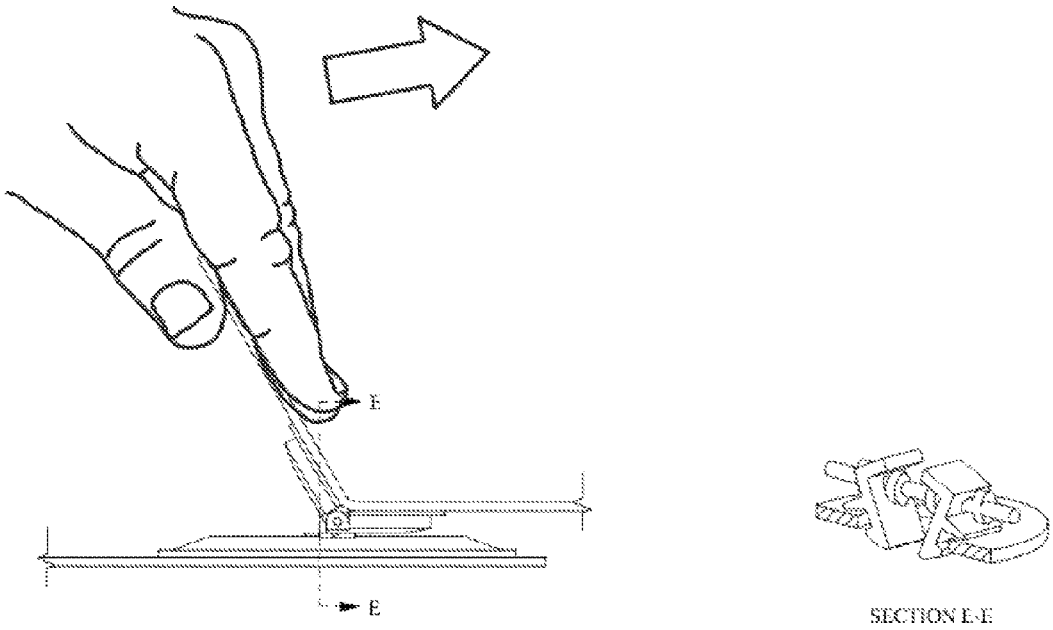
Figure 9F:
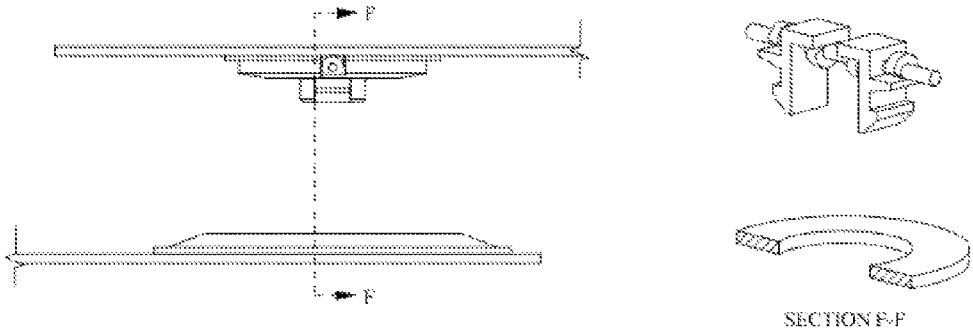

The preferred embodiments are preferably applied to fastening a cover flap to a bag and replacing the widely used hook and loop fasteners. In this application, as shown in FIGS. 9*a*, 9*b*, and 9*c*, the user preferably fastens the cover flap to the bag by pushing the cover flap against the bag and inserting the post 24 and lever 44 assembly into the aperture 12. To disengage the fastener, the user preferably lifts the cover flap away from the bag in a peeling motion, as shown in FIGS. 9*d*, 9*e*, and 9*f*. Alternatively, the fastener may be coupled to a handle or a strap and the user may lift the handle or the strap with a similar peeling motion to disengage the fastener. By attaching the fastener to a handle or a strap, the position of the fastener may be adjusted to adapt to the unique usage scenarios particular to individual users. The peeling motion is a very intuitive motion for lifting a cover flap to expose the opening to the bag. This intuitive motion and ease for fastener engagement and disengagement without an undesirable sound and without the risk of the fastener snagging onto clothing makes this invention an improvement over the commonly used hook and loop fasteners. In an application wherein the fastening of a flap to a bag may benefit from more than one point of attachment, the first component 10 may include a plurality of apertures 12 and the second component 20 may include plurality of posts 24 and levers 44, wherein each post 24 is coupled with a lever 44. The number of apertures 12, posts 24, and levers 44 are preferably equal and each of the post 24 and lever 44 pairs are preferably positioned to mate with one of the apertures 12. The levers 44 are preferably all coupled to one spring 42 that is actuated by one rotating actuator 30. Alternatively, each lever 44 may be coupled to one spring 42 that are each actuated by one rotating actuator 30. However, any other suitable combination of levers 44, springs 42, and rotating actuators 30 maybe used. More than one point of attachment may alternatively be achieved by having a plurality of first components 10 and a plurality of second components 20. Alternatively, the fastener may be applied to straps that benefit from quick releases. For example, a backpack with a strap that is split into two halves, each with one end attached to the backpack. The free ends are fastened to each other using the fastener such that, when the user desires to disengage the two free ends, the user can lift one free end from the other in a peeling motion and disengage the fastener. This allows for a much faster strap release than conventional buckles and strap holders. In addition, because the user's hand is already holding onto one of the free ends of the strap, the release of the strap is less likely to lead to a sudden drop of the backpack. In another example, a strap may have one end attached to a bag, clip, accessory, or any other suitable type of object and a free end mounted with a second component 20. The free end of the strap may then be used to fasten to any object where a first component 10 is mounted, for example, a piece of rolling luggage with a first component 10 mounted to the surface. The first component 10 may include a plurality of apertures 12 where a variety of objects with a strap with a second component 20 mounted to the free end may be fastened. Individual objects may be disengaged from the rolling luggage with the peeling motion described above for a quick release. However, any other suitable application may be used.

The first component 10 is preferably made from a molded plastic, but may alternatively be of a metal that may be cast or machined. Any other material or method suitable to create the geometry of an aperture 12 with mating surfaces for the second component 20 may be used. The base 22, rotating actuator 30, and sprung latch 40 are preferably made of the same material and preferably made from a molded plastic. In this variation, the hinge 50 may be a natural (or "living") hinge that is molded along with the base 22 and the rotating actuator 30, a separate axle that couples the base 22 and the rotating actuator 30, or any other suitable hinge. Alternatively, the base 22, rotating actuator 30, and sprung latch may be made of different materials. For example, the base 22, the rotating actuator 30, and the latch 44 of the sprung latch 40 may be made from a plastic material while the spring 42 is made from a metal material. The base 22, rotating actuator 30, and sprung latch 40 may alternatively be made of a metal material such as copper, brass, or steel to increase the durability and strength of the fastener. However, any other material suitable to create the second component 20 may be used.

The first component 10 and second component 20 may include first attachment elements 52 and second attachment elements 54 respectively that function to allow the first and second components 10 and 20 to be mounted to the desired application surfaces. As shown in FIGS. 1-8, the first and second attachment elements 52 and 54 are preferably a plurality of holes along the perimeter of the first and second components 10 and 20 that allow a thread to be passed through to sew the first and second components 10 and 20 to a relatively soft surface such as cloth, leather, or any other suitably pliable material for sewing. Alternatively, the first and second attachment elements 52 and 54 may be grommet or rivet geometry with backing pieces wherein the backing pieces are used behind each application surface to engage the first and second components 10 and 20 through the surface. The first and second attachment elements 52 and 54 may also be tabs for welding or gluing the first and second components 10 and 20 to the application surface. However, the first and second attachment elements 52 and 54 may be any other feature suitable to mount the first and second components 10 and 20 to the application surface. The first and second attachment elements 52 and 54 are preferably similar or identical types and methods of attachment, but may alternatively be any combination of the different types described above.

The preferred embodiments may also include a secondary spring to bias the rotating actuator 30 to the first actuator 30 position to further prevent the unintentional disengagement of the fastener.

The following descriptions of the preferred embodiments include all of the features and functions as described above.

1. First Preferred Embodiment

Figure 4B:
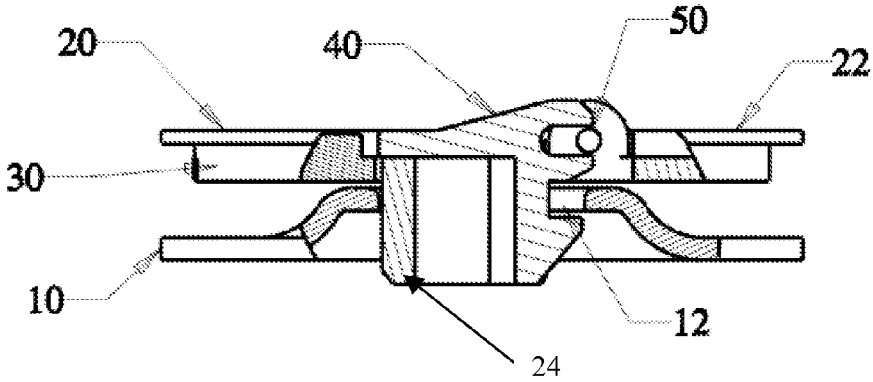

As shown in FIGS. 1-4, the rotating actuator 30 of the first preferred embodiment includes a spring holder 228 that supports the sprung latch 40 and includes a notch 232 and a rail 234 that prevents rotation of the spring latch 40 relative to the rotating actuator 30, the sprung latch 40 of the first preferred embodiment includes a finger 236 and a track 238, the hinge 50 is an axle 50 that couples the rotating actuator 30 to the base 22 and forms the axis 32, and the lever 44 of the sprung latch 44 further includes a hole 248 that allows the lever 44 to couple to the axle 50 while allowing translation of the lever 44 in a direction perpendicular to the axis 32 (shown in FIG. 4*b*).

The spring 42 of the first preferred embodiment is preferably a molded leaf spring that is coupled to the lever 44 into a unitary piece. The spring 42 of the first preferred embodiment is preferably plastic, but may alternatively be metal or any other suitable material. Upon displacement of the lever 44 from the first lever 44 position to the second lever 44 position (as shown in FIG. 4*b*), the spring is compressed and once the force displacing the lever 44 is removed, the spring 42 will return the original spring 42 state and return the lever 44 to the first lever 44 position. The spring 42 may alternatively be twisted, sheared, or extended. However, any other suitable spring type and spring actuation method may be used. The spring 42 is preferably secured and supported by the spring holder 228 and is coupled to the lever 44, which is coupled to the axle 50. The finger 236 of the sprung latch 40 is assembled into the notch 232 to prevent the sprung latch 40 from moving away from the rotating actuator 30 and the rail 234 is assembled into the track 238 to constrain motion of the lever 44 to the direction perpendicular to the axis 32. As the lever 44 is displaced, the track 238 slides along the rail 234 as the spring 42 compresses and expands. However, any other suitable arrangement of the spring 42 within the fastener may be used. The hole 248 allows the lever 44 to displace while remaining coupled to the axle 50 throughout the range of motion from the first lever 44 position to the second lever 44 position. The hole 248 may alternatively be an oblong hole that is closed but allows the same type and range of displacement of the lever 44. The hole 248 may also be any other suitable geometry or hole type.

The geometry of the flange 46 of the first preferred embodiment is in the form of a hook with a relatively angled top geometry that, when pushed against the perimeter of the aperture 12 upon insertion, causes displacement of the lever 44 to the second lever 44 position (as shown in FIG. 4*b*) and a relatively flat bottom geometry that interfaces with the flat perimeter of the aperture 12 upon engagement of the fastener (as shown in FIG. 4*a*) and, when in the engaged position, prevents displacement of the lever 44 to the second lever 44 position when the second component 20 is pulled away from the first component 10 without rotation of the rotating actuator 30.

Figure 4C:
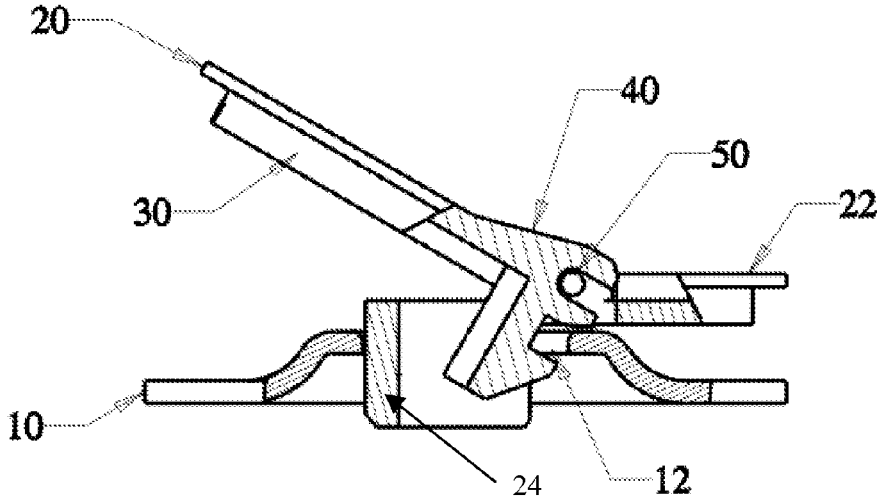

In the first preferred embodiment, the rest position of the second component 20 of the fastener is when the lever 44 is in the first lever 44 position. When the rotating actuator is rotated from the first actuator 30 position to the second actuator 30 position (as shown in FIG. 4*c*), the sprung lever 40 is also rotated along the same axis 32 and the lever 44 is rotated from the first lever 44 position to the rotated lever 44 position, allowing the post 24 and lever 44 assembly to be disengaged and extracted from the aperture 12.

2. Second Preferred Embodiment

As shown in FIG. 5-8, the base 22 of the second preferred embodiment further includes a spring holder 128 that secures and holds the spring 42, the rotating actuator 30 of the second preferred embodiment includes cam geometry 134, the sprung latch 40 of the second preferred embodiment includes a plurality of levers 44, preferably two levers 44 that are located 180 degrees from each other, and the levers 44 of the second preferred embodiment further includes follower geometry 136 and an angular flange 138. Similar to the hinge 50 of the first preferred embodiment, the hinge 50 is an axle 50 that couples the rotating actuator 30 to the base 22 and forms the axis 32. The lever 44 also includes a hole 148 that allows the lever 44 to be coupled to the axle 50 and to be constrained to movement along the axle 50.

The spring 42 of the second preferred embodiment is preferably a molded torsion spring that is coupled to the levers 44 into a unitary piece. The spring 42 of the second preferred embodiment is preferably plastic, but may alternatively be metal or any other suitable material. Upon rotation or displacement of the levers 44 from the first lever 44 position and towards the middle plane between the two levers 44 (shown in FIG. 8*b*), torsion is applied to the spring 42. Once the force rotating or displacing the levers 44 is removed, the spring 42 will return to the original spring 42 state and return the levers 44 to the first lever 44 position. The spring 42 may alternatively be compressed, sheared, or extended. However, any other suitable spring type and spring actuation method may be used. The spring 42 is preferably secured and supported by the spring holder 128 and is coupled to the levers 44, which are coupled to the axle 50. The spring holder 128 and the axle 50 prevent the spring 42 from displacement relative to the rotating actuator 30 while allowing the compression of the spring 42. However, any other suitable arrangement of the spring within the fastener may be used.

Figure 8A:
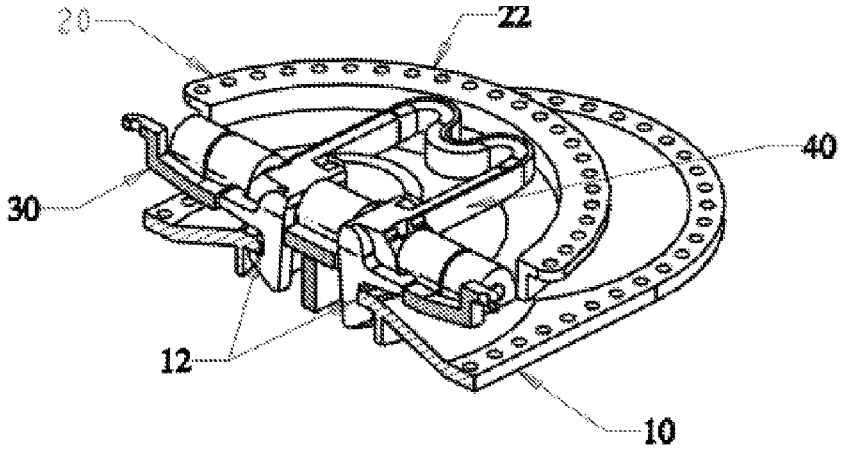
FIGS. 8*a*, 8*b*, and 8*c* are cross-sectional views of a second preferred embodiment FIG. 7 in the fastened, insertion, and actuated states, respectively.
Figure 8B:
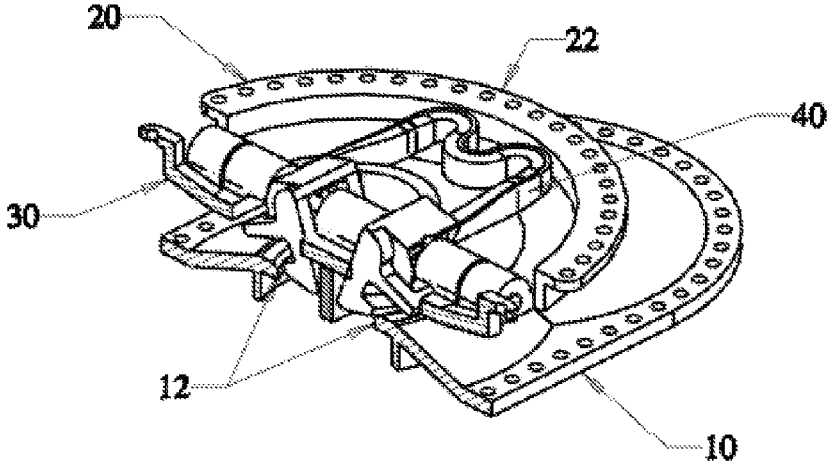

The geometry of the flange 46 of the second preferred embodiment is in the form of a hook with a relatively angled top geometry that, when pushed against the perimeter of the aperture 12 upon insertion, causes displacement of the lever 44 to the second lever 44 position (as shown in FIG. 8*b*) and a relatively flat bottom geometry that interfaces with the flat perimeter of the aperture 12 upon engagement of the fastener (as shown in FIG. 8*a*) and, when in the fastened mode, prevents displacement of the lever 44 to the second lever 44 position when the second component 20 is pulled away from the first component 10 without rotation of the rotating actuator 30.

Figure 8C:
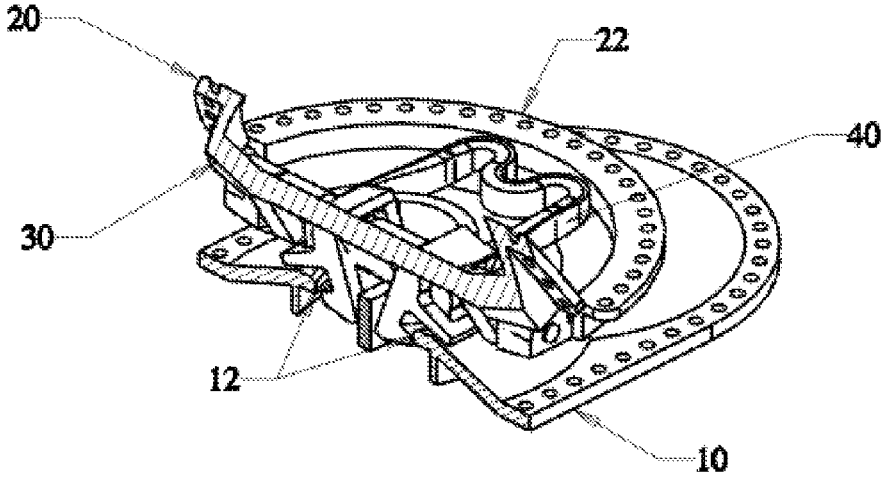

At rest, the cam geometry 134 and the follower geometry 136 allow the lever 44 to remain in the first lever 44 position. The rotation of the cam geometry 136 is preferably actuated by the user rotating the rotating actuator 30 from the first actuator 30 position to the second actuator 30 position. When rotated, the cam geometry 134 is in contact with the follower geometry 136 and functions to actuate the follower geometry 136 and rotate the lever 44 from the first lever 44 position to the rotated lever 44 position (as shown in FIG. 8*c*). In the second preferred embodiment, the cam and follower geometry 134 and 136 cause the lever 44 to rotate from the first lever 44 position to the second lever 44 position along an axis perpendicular to the axis 32 of the rotating actuator 30, but the lever 44 may alternatively rotate along an axis parallel to the axis 32 or any other suitable axis. When the user releases the rotating actuator 30, the spring 42 then functions to return the lever 44 to the first lever 44 position. The spring 42 preferably also provides enough force to return the cam geometry 134 to the rest position and subsequently returning the rotating actuator from the second actuator 30 position to the first actuator 30 position. In the second preferred embodiment, there are preferably two contact points between the cam geometry 134 and the follower geometry 136 for each lever 44. The contact points are preferably on opposite sides of the lever 44 to distribute the force to rotate the lever 44 from the first lever 44 position to the rotated lever 44 position between two follower geometries 136 to increase durability of the fastener. However, any other suitable arrangement of the cam geometry 134 and follower geometry 136 may be used. The cam geometry 134 and the follower geometry 136 are preferably located along the axis 32 but may alternatively be located in any other suitable location.

As shown in FIG. 8, in the second preferred embodiment, the second lever 44 position (shown in FIG. 8*b*) is preferably the same as the rotated lever 44 position (shown in FIG. 8*c*), but may alternatively be two different positions. The geometry of the lever 44, follower geometry 136, and angular flange 138 cause the lever 44 to remain at the same location along the axle 50 but able to rotate from the first lever 44 position to the rotated lever 44 position during insertion and when the rotating actuator 30 is rotated from the first actuator 30 position to the rotated actuator 30 position. The angular flange 138 allows for rotation of the lever 44 to a second lever 44 position that allows enough clearance for insertion and extraction of the post 24 and lever 44 assembly from the aperture 12 but prevents further rotation that may place unnecessary strain onto the spring 42. For example, when a large amount of force is applied to separate the first and second components 10 and 20 from the fastened mode of the fastener without rotation of the rotating actuator 30, the lever 44 of the second component 20 may be forced into a position further interior than the second lever 44 position and potentially cause plastic deformation to the spring 42. The angular flange 138 prevents this over rotation of the lever 44. The hole 148 preferably contains a geometry that allows the lever 44 to rotate from the first lever 44 position to the second lever 44 position while still coupled to the axle 50.

As a person skilled in the art will recognize from the previous detailed description and from the figures and claims, modifications and changes can be made to the preferred embodiments of the invention without departing from the scope of this invention defined in the following claims.

I claim:

1. A fastener assembly with a fastened mode and an unfastened mode comprising:

a first component including an aperture; and a second component including:

a base with a perpendicular post of a size appropriate to be inserted into the aperture in the fastened mode of the fastener and removed from the aperture in the unfastened mode, wherein the post defines a niche positioned along the perimeter of the post;

a sprung latch that includes a lever to fit into the niche of the post, wherein the lever includes a spring and a flange that extends beyond the perimeter of the post in a first lever position, wherein the lever is displaced from the first lever position to a second lever position that is interior to the first lever position upon insertion into the aperture and the spring returns the lever into the first lever position upon completion of insertion into the aperture and the flange of the lever subsequently engages a surface of the first component underneath the aperture and locking the first component to the second component into the fastened mode;

a rotating actuator that is coupled to the base, wherein the rotating actuator rotates about an axis on the base from a first actuator position to a second actuator position, wherein the rotation causes rotation of the lever from the first lever position to a rotated lever position, wherein the flange at the rotated lever position is interior to the flange at the first lever position, allowing the insertion and extraction of the post into and out of the aperture; and a hinge that couples the rotating actuator to the base and that forms the axis of rotation for the rotating actuator.

2. The fastener assembly of claim 1 wherein the assembly is biased into a position with the rotating actuator in the first actuator position and the lever in the first lever position.

3. The fastener assembly of claim 1 further comprising a relatively pliable surface and a relatively stationary surface, wherein the second component is mounted to the relatively pliable surface and the first component is mounted to the relatively stationary surface, wherein the fastener fastens the pliable surface to the stationary surface, and wherein the separation of the pliable surface from the stationary surface through a peeling motion rotates the rotating actuator from the first actuator position to the second actuator position, subsequently allowing the second component to disengage from the first component.

4. The fastener of claim 1 wherein the second component is mounted to a relatively pliable surface and the first component is mounted to a relatively stationary surface, wherein the separation of the relatively pliable surface from the relatively stationary surface through a peeling motion rotates the rotating actuator from the first actuator position to the second actuator position, subsequently allowing the second component to disengage from the first component.

5. The fastener assembly of claim 1 further comprising a first surface and a second surface that can be bent along a crease, wherein the first component is mounted on to the first surface and the second component is mounted onto the second surface such that the crease is on an axis substantially coaxial to the axis of the rotating actuator.

6. The fastener assembly of claim 1 wherein the first component contains a plurality of apertures for engagement with the second component.

7. The fastener assembly of claim 1 wherein the rotated lever position is equivalent to the second lever position and the spring also returns the lever from the rotated lever position to the first lever position.

8. The fastener assembly of claim 7 wherein the base of the second component further includes a sprung latch holder to receive and support the sprung latch and to allow movement of the lever from the first lever position to the second lever position and from the first lever position to the rotated lever position.

9. The fastener assembly of claim 7 wherein the lever rotates about an axis from the first lever position to the rotated lever position wherein the axis is perpendicular to the axis of the rotating actuator.

10. The fastener assembly of claim 9 wherein the rotating actuator includes a cam geometry and the lever includes follower geometry that contacts the cam geometry, wherein rotation of the rotating actuator rotates the cam causing the follower to follow the cam surface geometry and leading to the rotation of the lever from the first lever position to the rotated lever position.

11. The fastener assembly of claim 10 wherein the lever includes a plurality of points upon which the cam geometry and the follower geometry contact.

12. The fastener assembly of claim 7 wherein the lever includes angular flanges formed at an angle that allows the range of rotation of the lever from the first lever position to the rotated lever position and prevents over rotation.

13. The fastener assembly of claim 7 wherein the hinge includes an axle and the lever is coupled to the axle and contains an axle hole that allows the range of rotation of the lever from the first lever position to the rotated lever position while coupled to the axle and prevents over rotation.

14. The fastener assembly of claim 1 wherein the rotating actuator of the second component further includes a sprung latch holder to receive and support the sprung latch and to allow movement of the lever from the first lever position to the second lever position and from the first lever position to the rotated lever position.

15. The fastener assembly of claim 1 wherein the lever rotates about an axis from the first lever position to the rotated lever position, wherein the axis is parallel to the axis of the rotating actuator.

16. The fastener assembly of claim 1 wherein the first actuator position is substantially planar to the base.

17. The fastener assembly of claim 1 wherein the first actuator position is substantially perpendicular to the base.

18. The fastener assembly of claim 1 wherein the first component further includes attachment elements allow the first component to be fixed to a surface.

19. The fastener assembly of claim 18 wherein the attachment elements are selected from the group consisting of the following: a plurality of holes that allow the first components to be sewn onto the surface, tabs for glue application, tabs for welding, rivet geometry, grommet geometry, and backing materials placed behind the surface that interface through the surface with the first component.

20. The fastener assembly of claim 1, wherein the second component is biased into a position with the rotating actuator at the first actuator position and the lever at the first lever position.

21. The fastener assembly of claim 20 further comprising a secondary spring that biases the rotating actuator to the first actuator position and further prevents accidental release of the fastener.

22. The fastener assembly of claim 1 wherein the hinge includes an axle that couples the rotating actuator to the base and forms the axis of rotation for the rotating actuator.

23. A fastener assembly with a fastened mode and an unfastened mode comprising:

a first component including an aperture;

a second component including:

a base with a sprung latch holder and a perpendicular post of a size appropriate to be inserted into the aperture in the fastened mode of the fastener and removed from the aperture in the unfastened mode, wherein the post defines a plurality of niches positioned equally distant around the perimeter of the post;

a sprung latch supported by the sprung latch holder, wherein the sprung latch includes an integrated spring and a plurality of levers that each fit into one niche of the post, each lever including angular flanges, a hole, follower geometry, and a flange, wherein the flange in a first lever position extends beyond the perimeter of the post engages a surface of the first component underneath the aperture and locks the first component and the second component into the fastened mode, wherein the levers are integrated with the spring into a unitary piece;

a rotating actuator that includes integrated cam geometry that is in contact with the follower geometry at a plurality of contact points, wherein the rotating actuator is coupled to the base and rotates about an axis on the base from a first actuator position to a second actuator position;

an axle that couples the rotating actuator and the levers to the base and that forms the axis of rotation for the rotating actuator;

wherein the insertion of the post into the aperture and rotation of the rotating actuator from a first actuator position to a second actuator position cause the levers to rotate from a first lever position to a rotated lever position along an axis perpendicular to the axis of the rotating actuator, wherein the flange at the rotated lever position is interior to the flange at the first lever position and allows the extraction of the post, wherein the completion of insertion and return of the rotating actuator to the first actuator position allow the spring to return the lever to the first lever position, wherein the angular flanges of the levers prevent rotation of each lever beyond the rotated lever position, and wherein the holes of the levers allow the rotation of each lever from the first lever position to the rotated lever position while coupled to the axle.

24. A fastener assembly with a fastened mode and an unfastened mode comprising:

a first component including an aperture;

a second component including:

a base with a perpendicular post of a size appropriate to be inserted into the aperture in the fastened mode of the fastener and removed from the aperture in the unfastened mode, wherein the post defines a niche positioned along the perimeter of the post;

a sprung latch that includes an integrated spring and a lever that fits into the niche of the post, wherein the lever includes a hole and a flange, wherein the flange in a first lever position extends beyond the perimeter of the post and engages a surface of the first component underneath the aperture and locks the first component and the second component into the fastened mode, wherein the lever is integrated with the spring into a unitary piece;

a rotating actuator that includes a sprung latch holder to support and prevent rotation of the sprung latch relative to the rotating actuator, wherein the rotating actuator is coupled to the base and rotates about an axis on the base from a first actuator position to a second actuator position;

an axle that couples the rotating actuator and the lever to the base and that forms the axis of rotation for the rotating actuator;

wherein the rotation of the rotating actuator from the first actuator position to the second actuator position causes rotation of the lever from the first lever position to a rotated lever position along the axis of the rotating actuator, wherein the flange at the rotated lever position is interior to the flange at the first lever position and allows the extraction of the post; and wherein the insertion of the post into the aperture displaces the lever from the first lever position to a second lever position, wherein the flange at the second lever position is interior to the flange at the first lever position, wherein the spring returns the lever from the second lever position to the first lever position upon completion of insertion into the aperture, and wherein the hole of the lever allows the displacement of the lever from the first lever position to the second lever position while coupled to the axle.

* * * * *

UNITED STATES PATENT AND TRADEMARK OFFICE

CERTIFICATE OF CORRECTION

PATENT NO. : 8,122,574 B2
APPLICATION NO. : 12/421226
DATED : February 28, 2012
INVENTOR(S) : Kurt Philip Dammermann It is certified that error appears in the above-identified patent and that said Letters Patent is hereby corrected as shown below:

In column 8, line 61, “is mounted on to the first” should read --is mounted onto the first--

In column 9, line 27, “formed at an angle that allows the” should read --formed at angles that allow the--

In column 9, line 29, “and prevents over rotation” should read --and prevent over rotation--

In column 9, line 51, “attachment elements allow the” should read --attachment elements that allow the--

In column 10, lines 12 and 13, “niches positioned equally distant around” should read --niches positioned equidistant around--

In column 10, line 20, “the post engages a surface” should read --the post and engages a surface--

Signed and Sealed this
Seventeenth Day of April, 2012

David J. Kappos

David J. Kappos
*Director of the United States Patent and Trademark Office*